United States Patent [19]

Hester

[11] 4,216,455

[45] Aug. 5, 1980

[54] INDUCTIVE DEVICE WITH PRECISION WOUND COIL

[75] Inventor: Thomas E. Hester, Ft. Wayne, Ind.

[73] Assignee: Litton Systems, Inc., Beverly Hills, Calif.

[21] Appl. No.: 894,091

[22] Filed: Apr. 6, 1978

[51] Int. Cl.[2] ..... H01F 27/28

[52] U.S. Cl. ..... 336/160; 242/54 R; 336/189; 336/222

[58] Field of Search ..... 336/189, 190, 191, 220, 336/221, 222, 160, 165; 310/206, 207; 335/210; 242/54 R

[56] References Cited

U.S. PATENT DOCUMENTS

| | | | |
|---|---|---|---|
| 1,865,256 | 6/1932 | Johannesen | 336/190 |
| 2,930,014 | 3/1960 | Van Der Hoek et al. | 336/190 |
| 3,576,508 | 8/1971 | Liberman | 336/165 |

OTHER PUBLICATIONS

"Orthocyclic Winding of Magnet Wire Without Interleaving Materials", George, *Insulation Circuits*, Aug. 1976, pp. 43–46.

"Practical Aspects of Perfect Layer Coil Winding", George, *Insulation Circuits*, Nov. 1976, pp. 25–29.

*Primary Examiner*—Thomas J. Kozma

*Attorney, Agent, or Firm*—Robert A. Seldon

[57] ABSTRACT

An improved inductive device such as a transformer of the type containing a closed magnetic core, typically formed of magnetic laminations, with at least one coil-receiving core window and an electrical coil winding mounted on a core leg fitting through the core window, said coil being of a multilayer precision wound bobbinless construction in which the coil side to which a winding start lead extends faces an adjacent core leg, the improvement therein wherein the first turn of the first layer of the coil winding is interleaved between two turns of an overlying layer of winding turns and wherein the last turn of said first layer is also interleaved between two other turns of said overlying layer, whereby the spacing between the coil and magnetic iron core elements is increased to enhance electrical insulation.

A novel expandable arbor of the type containing two coupled arbor blocks each containing two longitudinally extending edges, each said edge having a plurality of wire receiving grooves extending transverse the edge between the ends of the arbor block and which in section view defines a sawtooth-like series of peaks and valleys, wherein the bottom of the first groove is located a distance from one said arbor end equal to the wire diameter and the first peak adjoins the arbor end and is a height greater than the other peaks for providing a slide surface into the first groove and the bottom of the last groove is located a distance from the other arbor end equal to a wire diameter.

13 Claims, 12 Drawing Figures

INDUCTIVE DEVICE WITH PRECISION WOUND COIL

BACKGROUND OF THE INVENTION

My invention relates to magnetic core inductive devices such as electrical power transformers and, more particularly, to a construction for a microwave oven power transformer of the high leakage reactance type embodying a coil winding of improved structure. An ancillary invention relates to an improved winding arbor construction useful in production of the coil winding construction.

A transformer is a known inductive type electrical apparatus which converts alternating current at one voltage and frequency typically to another AC voltage functioning by known principles of electromagnetic coupling and transformation between electrical windings on a magnetic core. Those skilled in the transformer art are familiar with the general principles of construction and operation of power transformers, including the contruction of that type of power supply transformer known as a high leakage reactance transformer having a principal application as an element of the power supply in the now familiar microwave oven appliance, as well as electrical insulation requirements thereof. The oven transformer structure in present commercial use includes at least a primary winding coil of enamel covered insulated wire, typically a "precision wound" coil, and a secondary winding coil, also typically a "precision wound" coil, mounted on the central core leg and within the core windows, of conventional E-I laminated magnetic core. The two coils are mounted on the core leg in a side-by-side relationship usually spaced apart a predetermined distance, and magnetic material, known as magnetic shunts, are sandwiched in between the two coils to produce sufficient magnetic leakage reactance between the windings as is desired by the power supply designer using known principles.

Magnetic core inductive devices must have other mechanical and electrical characteristics to be acceptable in commercial practice. Thus a sufficient degree of electrical insulation must be maintained between the electrical wire and the magnetic material and in the case of a microwave oven transformer this degree of insulation is customarily specified as a test breakdown voltage of some given level between the turns of the primary winding and the iron magnetic core material.

In the application of these transformers the iron core is maintained at electrical chassis potential, "ground" or "neutral", as variously termed, and the primary winding is maintained at an AC line voltage, typically 120, 208 or 240 volts in the majority of U.S. communities. To assure the sufficiency of winding to core insulation under normal operation, industry standards require that the primary winding insulation withstand a test voltage, much greater than line voltage, for a short interval. Thus, in present microwave oven transformers, a voltage insulation requirement between the primary winding and the core in the U.S.A. is a test 1,500 volts breakdown minimum applied for a duration of at least five seconds.

Typically, the electrical windings and shunts with the appropriate insulation completely fills the core windows leaving little or no window space. Maintaining the proper insulation would obviously be less difficult if one is permitted to mount the electrical windings in a larger and substantially more expensive transformer core having greater window space. That alternative is obviously not practicable from an economic standpoint.

In present transformer designs with which applicant is familiar, the insulation requirements for the primary winding coil are met in an insulation system design that includes a core insulator, typically a thin wrapper, described as a "core wrapper", on the central core leg over which the primary and secondary windings are installed; a thick spacer of electrically insulative material is inserted or sandwiched in between the side end of the primary coil and the adjacent core yoke leg; an L-shaped section member of electrically insulative paperlike material is located with one flap between the coil side overlying the thick spacer and the second flap thereof anchored between the inner coil periphery and the core wrapper; and a second L-shaped section member is located with one of its flaps in the space between the outer coil surface and the other flap laying over both the first flap and the aforementioned spacer. A still additional thin L-section shaped insulator member is fitted with one flap anchored between the coil's outer peripheral surface and outer core leg and the remaining flap extending down the primary coil's other side end. Thus, the electrical insulation in between the primary coil side and the adjacent yoke leg includes the thick spacer, relatively thick compared to the flaps, and the thicknesses of the two thin flaps of the L-shaped insulators. It is noted also that a principal purpose of one of the first mentioned L-shaped members is to retain the insulative spacer in place during production assembly of the transformer, which prevents the insulative "spacer" from slipping down into a position between the E-shaped lamination and the I-lamination during the manufacturing step of assembling the latter to the former. Likewise, insulation or equivalent spacing is provided between the remaining coil end and any magnetic shunt material adjacent said side.

Applicant's aforedescribed prior art construction satisfies the required electrical voltage breakdown ratings established in the microwave oven field and is produced in large quantities. Because the transformer is produced in large quantities, those skilled in the art recognize that any structural improvement therein which reduces the number of material elements or cost of elements or assembly of the transformer's insulation system, while retaining the desired degree of electrical insulation or improving same, represents a practical advance in the industrial arts and a purposeful assist in conserving natural resources.

To that end a principal object of my invention is to provide a new construction in a precision wound coil for a power transformer or other magnetic core inductor device which satisfies or enhances ancillary voltage insulation requirements, wholly or partially eliminating certain electrically insulative spacers. An ancillary purpose is to provide a suitable transformer construction capable of satisfying the electrical requirements for microwave oven power supply application with reduced material and assembly costs. An additional purpose of the invention is to provide a novel arbor construction useful in producing my transformer invention.

I am aware of a construction for a high leakage reactance transformer presented in U.S. Pat. No. 3,576,508, granted Apr. 27, 1971, in which a portion of the magnetic core is cut away at the corner between the center and yoke legs to enhance electrical insulation characteristics between the electrical coil and the transformer core. I believe that the different structure of my invention hereinafter presented to be a better solution in that it does not require a non-standard transformer core lamination.

SUMMARY OF THE INVENTION

The foregoing objects are accomplished in my invention with an inductor device containing a core of magnetic material on which is located a "precision wound" bobbinless electrical coil formed of a plurality of turns of electrically insulated conductor wire, and a yoke leg of magnetic material extends perpendicular to the central core leg so as to form a corner. A thin core wrapper of electrically insulated material is situated over the center core leg underlying said coil, and a thin insulating material is located in between the coil side and the perpendicular extending yoke leg. The electrical coil is formed in multiple layers of turns of electrically insulated wire in which adjacent rows are interleaved between the turns of other rows of wire without insulating wrappers between, forming essentially a precision wound coil. Characteristic of my invention, the first turn of the first layer of wire in this coil winding is positioned interleaved between two turns of an overlying layer of wire and is thereby laterally displaced from the yoke leg and from the one coil end, and the last turn of the first layer is positioned interleaved between two other turns of said overlying layer and is thereby laterally displaced from the other coil end and from any adjacent magnetic material, whereby the spacing, hence electrical insulation, between the first and last turns of the winding and magnetic core material is enhanced. Inasmuch as air or other intervening insulator material has an insulating effect, the additional physical distance or spacing serves to enhance electrical insulation in regard to the electrical breakdown characteristics of the inductive device to at least attain the standard breakdown characteristic, as do prior art constructions having additional insulating elements provided at greater cost and complexity of construction.

In my related invention, expandable arbors for winding wire of a diameter, D, of the type containing two relatively postionable blocklike elements, arbor blocks, which couple together to define a generally rectanguloid geometry and four spaced longitudinally extending edges along each of which is included a plurality of wire-receiving grooves or depressions, as variously termed, extending transverse the respective edge in between the arbor sides; and in which each edge in section view defines a sawtooth-like section geometry of a series of peaks and valleys, and wherein, in accordance with my improvement, the first and last "valley" or wire-receiving grooves are centered, respectively, a distance from the respective right and left arbor end by a distance equal to the wire diameter, the first and last "peaks" located at the arbor ends are of a height greater than other intermediate peaks in the sawtooth configuration, and a slide or guide surface extends from the arbor side at each said "peak" into the adjacent groove.

The foregoing and additional objects and advantages of my invention and the structure characteristic thereof, becomes more apparent to the reader from review of the detailed description of the preferred embodiment of the invention and of the manner of making and using same, which follows in this specification, considered together with the accompanying drawings illustrative thereof.

DESCRIPTION OF THE PREFERRED EMBODIMENTS

Figure 1:
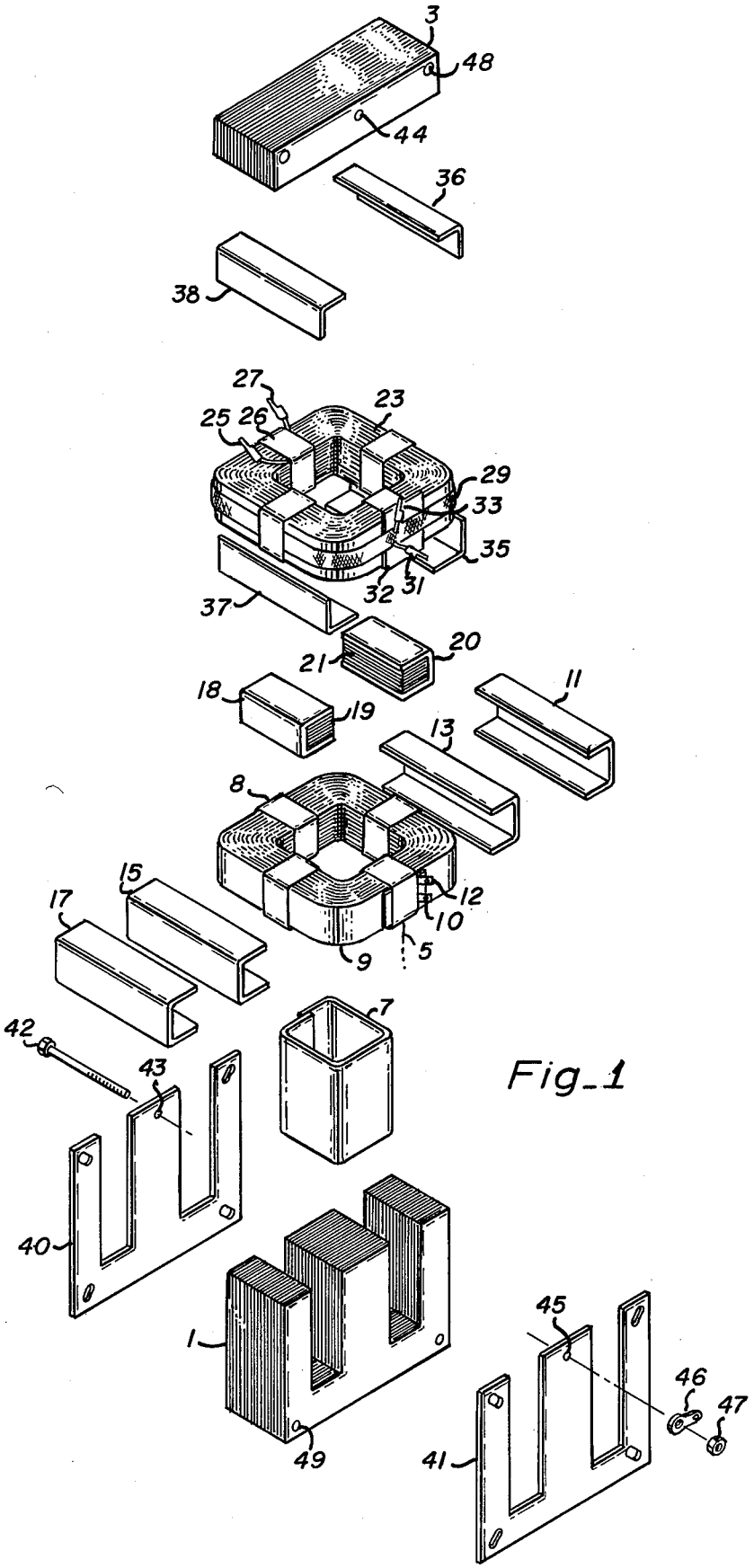
FIG. 1 illustrates in exploded view a transformer containing my invention.

As presented in the exploded view of an embodiment of the invention in FIG. 1 to which reference is made, the transformer includes a closed magnetic core of known structure formed of a stack of E-shaped laminations 1 and a corresponding stack of I-shaped laminations 3 of iron material. The center stem of the E-lamination forms the center core leg and a thin wrapper 7 of electrically insulative and non-magnetic material, typically "Nomex", an aromatic polyamide product, is provided to wrap about that center core leg. A first electrical coil 9 is provided for installation on the central core leg and fits within the "core windows" formed between the center and outer core legs. Coil 9 is of a conventional multiturn multilayer precision wound bobbinless construction. The coil is secured together by tapes 8 and contains "start" lead 5, tap lead 10, and finish lead 12 terminals. Two thin U-section shaped insulators 11 and 13 are provided to fit within the core window and cover the coil periphery and end sides. A corresponding pair of U-section shaped insulators 15 and 17 are provided for the opposed side. Two magnetic iron shunts 19 and 21 formed of stacks of rectangular laminations are inserted in a side-by-side relationship in this window, the shunts being carried by U-section shaped insulator members 18 and 20 to provide suitable insulation between the sides of the shunt and the sides of the abutting coil 9 as well as the second coil described later in this specification. A second electrical coil 23, a primary winding of electrically insulated wire, suitably an enamel insulation, and of a precision wound bobbinless construction, is thereafter installed over core wrapper 7 on the center core leg of E-lamination 1. Electrical coil 23 contains a winding "start" lead 25 and a winding "finish" lead 27. Typically, the coil is wrapped by two or more strips of tape 26 to ensure that the coil is retained in proper form. And for completeness, a third winding 29 of electrically insulated wire is shown supported on coil 23, consisting of three or four turns of insulated wire in a single layer between its start and end leads 31 and 33, with an insulating tape overlying and securing the turns of the winding and an insulating paper 32 under leads 31 and 33. Winding 29 is provided typically for supplying low AC voltages to a magnetron's heater terminals and is sometimes referred to as the heater winding.

Four elongate L-section shaped thin insulative cardboard-like members 35, 37, 36 and 38 are provided, two located on each side of coil 23 as shown. Insulator members 35 and 37 are anchored between the coil peripheral surface and an outer core leg of E-lamination 1 with a flap portion of each extending along the coil end side toward the center core leg sandwiched between the coil side and the respective one of the shunts 19 and 21. Insulator members 36 and 38 are likewise anchored between the coil outer periphery and an outer core leg overlying a flap portion of the other insulator member 35 or 37, respectively, and with a flap portion of each extending inwardly toward the center core leg of E-lamination 1 to provide an insulative barrier between the other end side of coil 38 and the confronting side of the I-lamination, between which the respective flaps are sandwiched. I-shaped lamination 3 is installed in abutting relation with the ends of the E-shaped lamination and the insulation provided by members 36 and 38 preventing any direct electrical contact between the insulated conductors of coil 23 and I-lamination 5. The E-shaped members 40 and 41 are "keepers", E-shaped iron laminations containing stems that are greater in length than E-laminations 1, are are conventional in the transformer art. After the I-lamination is put in place, the center legs of the keepers are inserted under core wrapper 7 and extend over the I-lamination. Bolt 42 extends through aligned passages 43 and 45 in the keepers and 44 in the I-lamination, a terminal 46 is inserted and the bolt is fastened by nut 47 to secure the assembly mechanically together. Other bolt passages 48 and 49 may be provided in the keepers and laminations for securing the transformer to mounting brackets. Thereafter the I-lamination is rigidly joined to the E by means of weld seams located along the junctures obtained by known arc welding process.

Figure 2:
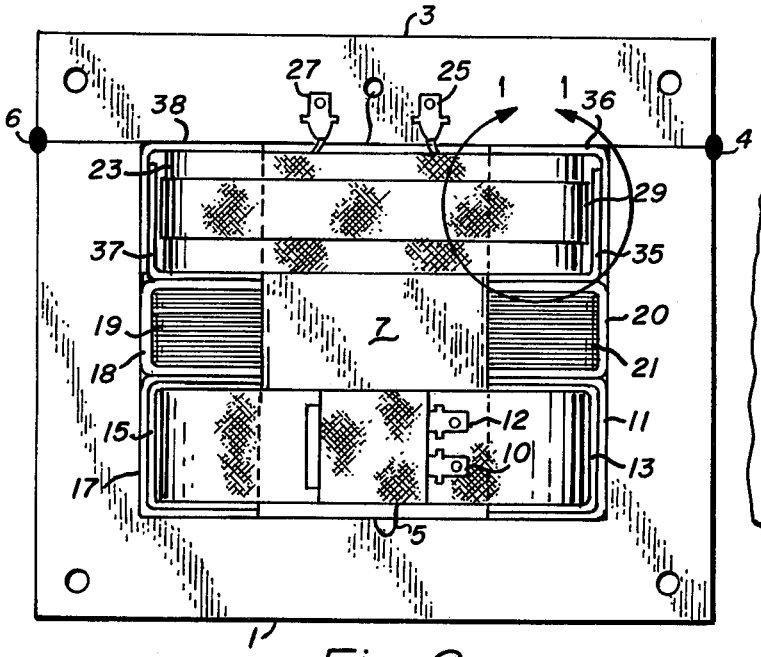
FIG. 2 illustrates the transformer of FIG. 1 in an assembled side view.

The transformer of FIG. 1 is illustrated in assembled relation and to slightly greater scale in FIG. 2 as viewed from a side thereof, to which reference is made. For convenience, the elements of the transformer previously identified in FIG. 1 are identified by the same numerals in this FIG. 2 and hence need not be described in great detail. And coil 23 is rotated 180 degrees about its axis from its proper orientation, as presented in FIG. 1, in the view presented in this FIG. 2 for providing a better illustration. The retaining welds which join the E and I lamination as well as the "keepers" are illustrated at 4 and 6. The "keepers" are omitted from this figure. In this view the apperance of the U-shaped insulator members which carry the shunt of magnetic material, are visible as at 18 and 20. The depending sides of the U-shaped member electrically insulates the sides of coils 23 and 9 from the electrically conductive magnetic material of the shunt. Start lead 5 of secondary winding 9 extends under core wrapper 7 to the I-lamination, where it is connected to the core electrically by terminal 46, visible in FIG. 1. In typical structures the entire transformer assembly is impregnated with an insulative heat conducting varnish to further enhance the characteristics of the transformer, either by dipping or by vacuum impregnation of same, all of which is conventional practice understood by those skilled in the art.

Figure 3:
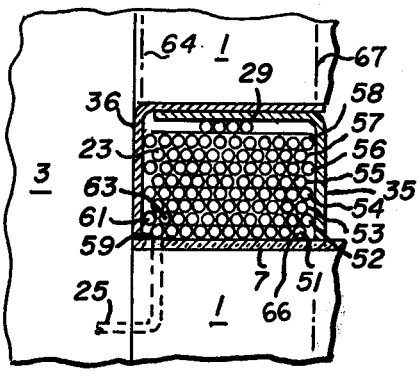
FIG. 3 illustrates a partial section view of the portion of the transformer of FIG. 2 taken along the lines 1—1 and the embodiment of my invention.

Reference is now made to the precision wound coil construction presented in the partial section view of FIG. 3 taken from 1-1 in FIG. 2 and in which identical elements are identically labeled. The I-lamination leg 3, the center core leg of the transformer of E-lamination 1, an outer leg of E-lamination 1, the L-shaped insulators 35 and 36 and the core wrapper insulator 7, and coil windings 23 and 29 are presented. In this view, coil 23 is seen to comprise a plurality of turns of wire arranged in multiple layers, including, by way of example, the first layer 51, the second layer 52, the third layer 53, the fourth through eighth layers 54, 55, 56, 57 and 58.

It is seen that each of the even numbered layers has one more turn than the odd numbered layers. However, in some instances the last layer, such as 58 in the disclosed figure, need not contain more turns than the underlying layer, since it holds the remainder of the desired turns in the complete winding and may have less. This alternative remains within the scope of my invention. The first turn of the first layer is designated 59 in the figure. Additionally, "start" lead 25 of the winding is shown in this figure connected to the first winding turn 59 to ensure an understanding of the relationship of the elements.

In a precision wound coil known to those skilled in the art, and sometimes referred to alternatively as "orthocyclic" wound or "perfect layer" wound, a multilayer electrical wire coil is formed by winding a first row or layer of essentially parallel turns of wire which form grooves in between turns and then winding the next layer of wires so that the majority of turns thereof position themselves within the grooves formed by the turns of the preceding layer, and so on for additional layers of wire turns. And this arrangement, though more difficult in practice, obviates the need for a wrapper of layer-to-layer insulation between the turns of each wire layer and permits a more compact coil than obtained from other designs using layer-to-layer insulating material.

In the precision wound coil of this invention, the first turn 59 of the first layer, to which start lead 25 is connected integrally, lies within the groove formed between or is interleaved, as variously termed, with the two turns, designated 61 and 63, of the second or overlying layer of wire turns. Thus, turn 59 is displaced a distance, specifically one-half of the wire diameter, from the coil side insulator 36 and, hence, from side yoke leg 3 or from the coil side as defined by a plane 64 orthogonal to the plane of the drawings and tangent to the first turns on the left hand side of the second, fourth, sixth, and eighth layers of wire, which distance is greater than the distance by which turn 61 of the overlying wire layer is spaced from the corresponding reference position. The center of the wire 59 is one diameter distance from plane 64. The distance from the corner formed between the center core leg of E-lamination 1 and I-lamination 3 is a greater distance than the prior art designs.

In addition, the last turn 66 of the first layer is displaced or spaced from the right side end of coil 23, which end is represented by the plane 67 drawn tangent to the end turns of the even numbered wire layers, specifically by one-half of a wire diameter, D, and is interleaved between two turns of wire in the overlying second layer of wire turns.

As is apparent to those skilled in the art, coil 23 is of a bobbinless design. By contrast, in a bobbin type coil the turns of the electrical coil are wound upon a bobbin structure having side walls that provide necessary insulation between the magnetic core and the coil. In practice, bobbin type coils could form an alternative to the present invention in transformers for microwave oven power supply circuits but requires additional materials and hence additional manufacturing cost. Also in practice, precision bobbinless coils of this type are made of a wire diameter in which the formed coil is essentially semi-rigid after formation and in a sense the electrical coil can be characterized as self-supporting with no more than a few strips of adhesive tape serving to generally hold the turns of the coil closely together.

In practice, I desire the first turn 59 of the first layer of wire turns in primary coil 23 to be displaced from the adjacent coil side by defining that coil side by a tangent plane 64 previously described, approximately a distance equal to one-half the diameter, D, of the electrical wire used in the winding. The prescribed coil structure thus includes greater spacing and, hence, enhanced electrical insulation between the right side end of the coil and the adjoining magnetic iron parts, such as the shunt 21 assembly, not illustrated in this figure, which abuts that side of the coil. As a result of the foregoing construction it is noted that the first layer in the coil structure illustrated and the odd numbered layers contain one less turn than the second and even numbered layers of wire; eleven turns illustrated for the odd and twelve turns in the even numbered layers. In addition to affording enhanced insulation in a properly assembled transformer, the invention also provides the attendant advantage should assembly be out of tolerance in specific instances in production manufacture: for example, if the end of the insulator flap 36 does not extend down to the core wrapper 7 or should the core wrapper 7 not extend to the I-lamination 3, either of which results in a gap exposing the bare metal of the core lamination of either 1 or 3 at the corner. Hence, if the first turn 59 is not displaced, the first turn would be in very close physical proximity to the lamination and be susceptible to creation of an electrical breakdown or arcing during test or in use at test voltages lower than that which the construction of my invention is capable of withstanding, such as a $<1{,}500$ volt test voltage. Inasmuch as coil 23 is essentially symmetrical, a section view corresponding to 1—1 may be taken between the center leg and the remaining outer leg of E-lamination 1 and define the same relationship as that illustrated in 1—1.

Figure 4:
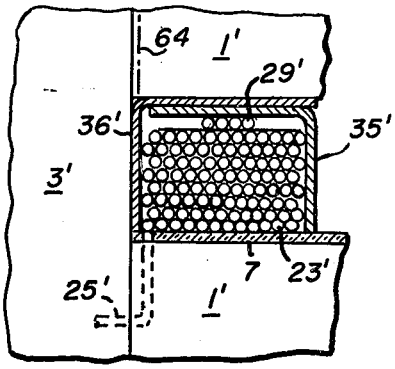
Fig 4 PRIOR ART
FIGS. 4 and 5 illustrate partial section views of prior art transformer coils corresponding to the view presented in FIG. 3.

FIG. 4 is a partial illustration in section, corresponding to that of FIG. 3, taken of a precision wound coil of the prior art presented for comparison. For ease of understanding the corresponding elements are identified by the same numeral but a prime is employed to distinguish this from the other figures. In this, the first turn 59' of the first layer of wire in coil 23' is located directly at the side surface of the coil and abuts the insulator 36'. In this prior art coil construction, a turn of the second layer which is interleaved in the grooves between the first and second turn of the first layer of wire turns and is displaced from core leg 1', whereas observing the right side end surface of coil 23' it is seen that the last turn of the first layer is displaced from the right hand coil side. And the layers of wire, considering all but the last, have the same number of turns. In the abstract sense, it would appear that the construction of the coil in the transformer, according to the teachings of my invention, departs from the prior art coil construction in part in a general sense, in that one appears to constitute in part a reverse of the latter with accompanying relocation of the "start" lead considering only the appearance of the coil in the cross-section view. As is apparent, should any gap exist between the end of insulator 36' or the core wrapper 7', and the juncture of the center core leg of the E-lamination and the side yoke leg of the I-lamination, or both, the wire 59' would be in close physical proximity to the bare iron of the magnetic laminations 1' and 3' and under that condition the transformer is less likely to be capable of withstanding test breakdown voltages which the invented structure is capable of meeting, such as on the order of 1,500 volts between the winding and the iron lamination which present practice in this field requires. The structure of FIG. 4 is thus illustrative of basically a transformer structure which I regard as unacceptable in practice or impractical, even though a transformer so constructed may be operable to provide the desired voltages and operating currents in a microwave oven power supply.

Figure 5:
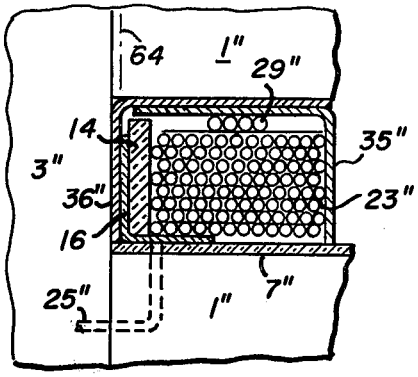
Fig 5 PRIOR ART

The corresponding detail of a section of a practical transformer construction of prior design is illustrated in FIG. 5 which corresponds to the section view of FIG. 3 for purposes of comparison. In this, the conventional precision wound coil 23'', including the start lead 25'', is situated in the core window between the outer yoke leg 3'' and the center leg 1''. A first thick spacer 14 of electrically insulated material, such as glass polyester, approximately 1/16 inches thick, is sandwiched in the left side end surface of the coil. An L-shaped flap of electrically insulating material 16, suitably Nomex, is wedged in between the upper surface of the center core leg wrapper 7'' and extends upwardly along the covering insulator spacer 14. This is in addition to the elongate L-section shaped insulating material 36'' wedged in between the outer core leg and the outer surface of the coil and has its downwardly extending flap extending over the surface of the insulator 14 and the flap of insulator 16. Hence, the three insulating surfaces are sandwiched in between the I-shaped lamination and the end surface of the core. It is noted that insulator 16 is primarily included to hold the insulator 14 in place during assembly of the transformer so that the insulator 14 does not slip out of position as might fit into the crack between the I and E-laminations. It also serves the additional purpose of affording extra insulation in the corner region between the I and E-lamination. Likewise, insulator 36'' functions both to insulate the outer surface of the coil from the metal contact at the corner juncture between the outer core leg of the E-lamination and the I-lamination, as well as to assist in maintaining the position of the spacer during assembly of the transformer. The first turn of the first layer of the winding is insulated adequately. The extra insulators require assembly insertion and, importantly, take up core window space, which reduces the space available for windings. In addition, spacers such as 14 are of an expensive "Nomex" material. As those skilled in the art appreciate, the seemingly simple change in the combination as specified herein reduces the requirement for two pieces of insulation while providing a practical operative transformer. As a consequence, the function performed in the prior art design by these insulating strips is performed by the configuration of the novel structure resulting in a more economical transformer design, one which requires fewer industrial resources to construct, both labor and material. With that accomplishment I regard the new structure as an advance in the practical electrical arts.

In a practical embodiment of the invention, a transformer was constructed in which the primary winding consisted of 116 turns of No. 13½ wire insulated with enamel, formed into 8 layers and is of a generally rectanguloid geometry and is of a relatively short axial extent between its right and left side ends. The coil is capable of carrying current on the order of 14 amps with an applied 120 volt RMS 60 Hertz voltage applied across the winding. The odd numbered layers have 14 turns and the even numbered layers contain 15 turns. A secondary winding consisted of 2,090 turns of No. 26 enamel insulated wire formed in 38 layers, capable of carrying 0.75 amps. The E-I configuration comprised a stack of E-laminations 0.025 inches thick, tempered steel stacked to form a height of 1 15/16 inches. The core wrapper consisted of Nomex paper having electrical insulating properties of approximately 1,500 volts measuring 0.015 inches thickness. The outer U-shaped insulators 11, 13, 15 and 17, as well as the L-shaped insulators 35, 36, 37 and 38, consisted of Nomex paper approximately 0.020 inches in thickness. The coils each measured approximately 1 1/32 inches in width and the magnetic shunts consisted of 16 number of magnetic laminations approximately 0.793 inches by 2.00 inches. The insulating member or carrier for the shunts was of a thickness of 0.062 inches so that one end provided an air gap of 0.062 inches whereas the core wrap provided an additional air gap of 0.015 inches. Suitably, the transformer is dipped in a suitable electrical grade varnish.

The reader skilled in the art recognizes that the improved precision wound coil constructed defined in this specification, although discussed in connection with microwave oven power transformers of the high leakage reactance type with which it has particular benefit, has application as well to other types of transformers and inductors.

Given the teachings contained in this specification and the requirement to do so, those skilled in the art I believe possess the skill necessary to fabricate precision wound coils of electrically insulated wire in the manner prescribed for use as an element in my novel transformer construction manually or with a combination lathe or coil winding apparatus using a manual starting procedure to place the initial winding turn at the prescribed location on a bobbin or expanding arbor and thereafter allowing automatic operation to complete the winding of the electrical coil. Precision wound coil structures and winding are old and known, and are for example discussed in the article "Orthocyclic Winding of Magnet Wire Without Interleaving Materials", George, which appears on Pages 43 through 46 of the magazine Insulation Circuits, August 1976, and a companion article entitled "Practical Aspects of Perfect Layer Coil Winding", George, appearing on Pages 25 through 29 of the magazine Insulation Circuits, November 1976, to which the reader may make reference. As is brought out in those articles, a precision wound coil may be manufactured on a bobbin or manufactured by using the well-known expandable arbor, the latter of which I prefer for mass production manufacture of bobbinless self-supporting electrical transformer windings. Large quantity production manufacture of prior art "precision wound" windings used expanding arbors having grooves situated on the edge surfaces much as outlined in the aforecited articles to accomplish those prior art designs. A similar type of arrangement is preferred for the production manufacture of the novel transformer winding incorporated in my invention and, accordingly, I have invented a novel expanding arbor to assist in that purpose, the details of which are depicted in FIGS. 6 through 12. Inasmuch as the details and specific mode of operation of coil winding machinery is not necessary to an understanding of the inventions and is assumed known to those skilled in the art of transformer manufacture using precision windings, they are not described in this specification and readers of less skill may make ready reference to the prior art literature, including patent literature, as well as to brochures and products provided by manufacturers and businesses engaged in the design and manufacture and sale of coil winding machinery.

Figure 6:
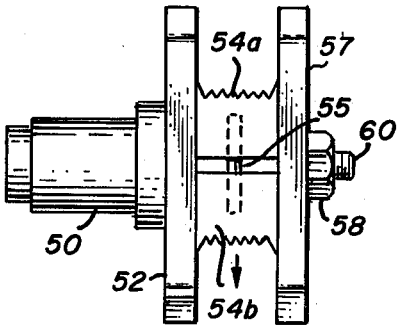
FIG. 6 illustrates an expandable arbor mechanism.
Figure 7:
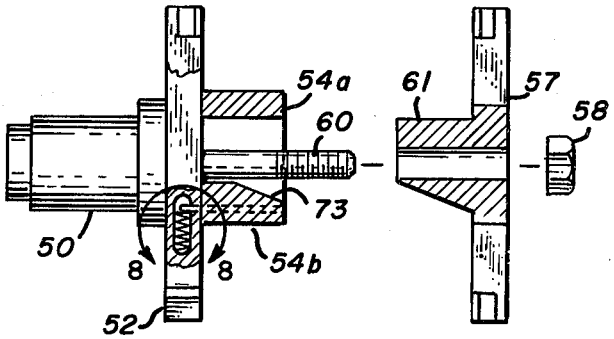
FIG. 7 illustrates in partial section view an exploded view of the arbor of FIG. 6.
Figure 8:
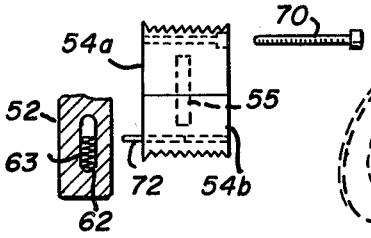
FIG. 8 illustrates a pair of arbor blocks.

Those familiar with the art of precision wound bobbinless electrical coils are familiar with the expandable arbor mechanism used in the fabrication of such coils and recognize that mechanism as depicted pictorially in a side view in FIG. 6 and in the views of FIGS. 7 and 8. The expandable arbor mechanism includes cylindrical shaft 50, a first rectangular shaped side plate 52, expanding arbor blocks **54*a* and 54*b* coupled by a pair of guide pins, such as guide pin 55, a second removable side plate 57, and the mechanism is held together by means of nut 58 on threaded shaft 60, the latter of which is attached to plate 52, all constructed from steel material, assembled in a configuration resembling a rectangular shaped coil bobbin on which an electrical coil is to be wound. As depicted in the partial side section view of FIG. 7, side plate 57 contains a protruding portion 61 having a tapered surface. Side plate 52 contains a pair of slots 62, each containing a spring loaded member 63, one of which is partially illustrated in FIG. 8. Side plate 52 also contains a pair of threaded holes, not illustrated. The arbor block 54*a* is fastened to side plate 52 by means of bolts 70, depicted in FIG. 8. The lower portion 54*b* includes projecting guide pins 72 which fit within slot 62 in side plate 52 and are pressed upwardly by the spring 63. In turn, the upper portion 54*a* carries a pair of pins, such as guide pin 55, which fits in a respective channel in block 54*b* to couple the blocks together for relative movement. Lower block 54*b* includes a tapered surface 73 with a slightly more gradual taper than that on protruding portion 61. Hence, when plate 57 is mounted on shaft 60 and pushed axially inwardly toward plate 52, the tapered surfaces engage and the protrusion 61 on plate 57 forces the movable block 54*b* downwardly to an extent against the pressure of spring 62 exerted against pin 72 forcing the arbor block assembly to expand to its maximum size in preparation of coil winding. The two plates and arbor blocks are secured in this expanded position by fastening nut 58 in place on threaded shaft 60. At the conclusion of a coil winding operation, plate 57 is withdrawn, as represented in FIG. 7. This allows spring 62, which pushes against pin 72, illustrated in FIG. 7, to force block 54*b* back against the upper block 54*a*** and hence to the "collapsed" position of the arbor. The arbor thus becomes smaller in size than the center of the wound wire coil and the coil may be withdrawn from the arbor.

Figure 9:
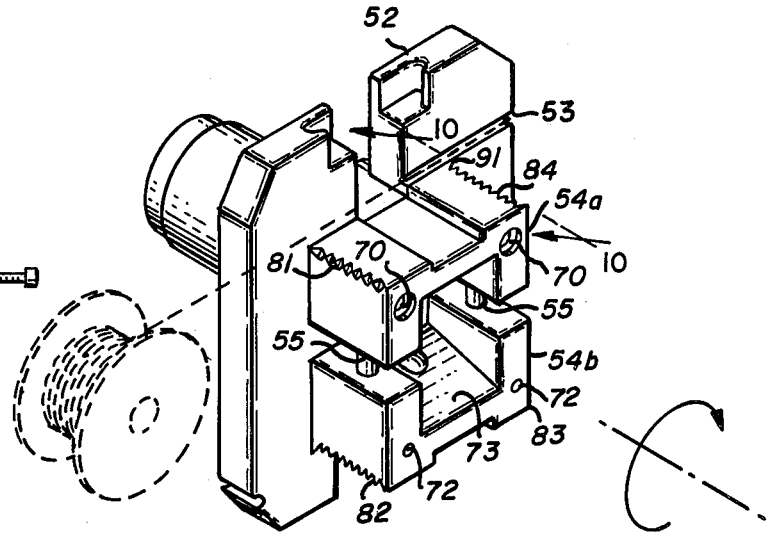
FIG. 9 illustrates the invention in an expandable arbor used for winding the electrical coil of the embodiment of FIGS. 1, 2 and 3.

In FIG. 9 I illustrate to a slightly greater scale the arbor block assembly **54*a* and 54*b* in the expanded position on side plate 52. For clarity of illustration, the companion side plate and threaded shaft 60, previously described, are omitted from the figure. In this view, fixed arbor block 54*a* includes mounting bolts 70 which extend through the block and attach to plate 52. Depending guide pins 55 carried by block 54*a* are received within passages within movable arbor block 54*b***. Each of the four edges of the arbor block assembly contains series of wire receiving grooves generally indicated as 81 and 84 in block 54*a*, 82 and 83 in the movable block portion, and the edges define a rectanguloid geometry. The number of grooves in each series corresponds obviously with the number of turns of wire desired to be formed in the first wire layer of the coil to be wound. In the fabrication of an electrical coil, one end of a dispensed electrically insulated wire, symbolically illustrated in dash lines, such as enamel coated insulated wire, is inserted into a lead slot 53 in the plate 52 to anchor the end for winding. That wire end, it is noted, is the "start" lead of a formed winding. Rotation of the arbor in coil winding machinery, not illustrated, wraps the wire around the arbor with the turns in the first layer being forced into the grooves. The groove series 81, 82, 83 and 84, situated at each corner of the arbor block assembly, forms a convenient guide to place the wire turns during winding, as described in the prior art publications herein cited. As the arbor revolves the winding progresses from the left to the right end to form the first layer; the wire then jumps above the first layer and forms a second layer which is interleaved essentially with the turns of the first layer. Winding of the second layer progresses to the other side plate. Consequently the next turn jumps the turns between the underlying layer and winding proceeds again left to right until the wire abuts the right hand plate 57 where the wire proceeds again to jump to form the next succeeding layer of wire turns. This process as described in the literature continues during automatic winding until the proper number of turns is wound in the number of layers desired, suitably indicated by the turn counter on the coil winding machinery. The winding end or "finish" lead is then clipped and brought out to the side of the coil, usually on the same side of the coil as the "start" lead earlier mentioned. Thereafter, the removable side plate is withdrawn, the arbor blocks move to the collapsed position, and the formed electrical coil is taken off of the arbor. Suitably, the formed coil is secured with adhesive tape as a precautionary measure to retain the coil in the wound form.

Figure 10:
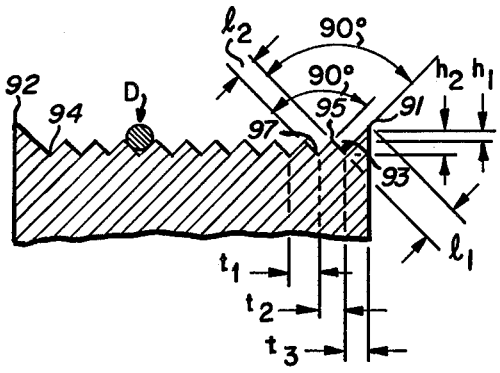
FIG. 10 illustrates a partial section view of the arbor block of FIG. 9 taken along the lines 10—10.
Figure 11:
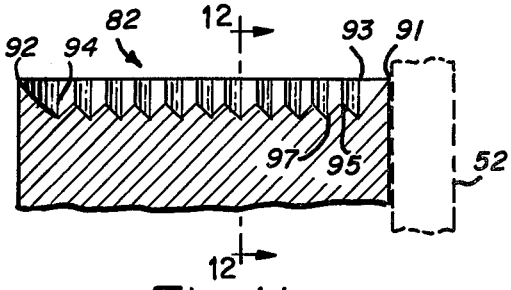
FIG. 11 is a partial side view of the arbor block of FIG. 9.
Figure 12:
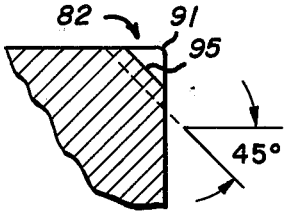
FIG. 12 is a partial section view of the block taken along the line 12—12 in FIG. 11.

The improved structure of the arbor block assembly depicted is in the shaping of the wire receiving grooves and is more particularly illustrated in FIGS. 10, 11, and 12. FIG. 10 is a section view of the upper arbor block of FIG. 9 taken along the line 10—10. FIG. 11 is a side view thereof and FIG. 12 is an end view partial section taken along 1—1 of FIG. 11. The groove structure of each of the remaining three edges of the arbor block assembly is essentially the same as the groove arrangement 82 hereinafter considered in detail. The section of FIG. 10 presents a groove structure which in appearance resembles a sawtooth structure having a series of peaks and valleys commencing with a first "peak" 91, a first "valley" 93; a second peak 95 and a second valley 97; and a last peak 92 and a last valley 94. The second peak and all of the peaks and valleys of the groove structure intermediate the first and last are of the same height and depth, respectively, as peaks 95 and valley 97. Peak 91 is greater in height than peak 95. The relationship between peak 91 is clearly further illustrated in the end view of FIG. 12 and the side section view of FIG. 11. By way of specific example, the angle formed between the side walls of the groove and the valley or deepest point of the groove is approximately 90 degrees, as may be formed by a 90 degree cutter. The length of the shorter side $L_2$ is approximately equal to the diameter, D, of the wire to be would upon the arbor divided by $\sqrt{2}$. The length of the greater side, $L_1$, to the first peak 91 is approximately twice as great, 2L, or equal to the wire diameter multiplied by $\sqrt{2}$. The distance between the valleys in the regular portion of the toothlike geometry, such as $d_1$ and $d_2$, are essentially identical and the distance between the first valley to the peak 91, $d_3$, is approximately the same length. Mathematically it can be shown that the spacing distance between the center of the valleys or deepest points of the adjacent grooves is equal to the wire diameter; and the height of peaks 91 and 92 is equal to the wire diameter; and the height of the smaller intermediate peaks is D/2. Hence, the difference in height between the first and last peaks and the remaining intermediate peaks is approximately D/2, where D equals the wire diameter. As is apparent, the sloping side wall between peak 91 and the center of the first valley forms a slide or guide surface for the wire. In forming the initial turn of the winding the wire slides down and is guided into the first groove. The arbor block of the invention thus automatically locates the wire away from the side of plate 52. In contrast, the prior art arbors with which I am familiar contain peaks of uniform height with the center of the first valley located at a distance from the plate of one-half of one wire diameter D. Hence, the first winding turn of the first layer in a winding is located in a position abutting the side plate 52. The arbor described herein permits production coil winding of coils used in the transformer invention described in this specification. Thus, in the improved arbor block construction, the larger peaks are located at the right and left side ends, whereas the smaller peaks of reduced height are intermediate the two so as to give the overall section view appearance of a fanglike sawtooth configuration.

It is believed that the foregoing description of the preferred embodiment of the invention is sufficient in detail to enable one skilled in the art to make and use the invention without the necessity of undue experimentation. Nonetheless, it is expressly understood that the details of such description presented for that purpose are not intended to limit the scope of the invention inasmuch as substitutions of equivalent elements as well as modifications or even improvements to the invention, all of which embody the invention, become apparent to those skilled in the art upon reading this specification. By way of example, mention was made of the structure disclosed in U.S. Pat. No. 3,576,508, issued Apr. 27, 1971. That structure may be combined with the structure of this invention at some additional expense to provide an even more improved structure. Accordingly, it is respectfully requested that my invention be broadly construed within the full scope and spirit of the appended claims.

What I claim is:

1. In a power transformer of the type containing a magnetic iron structure, formed of laminations of magnetic iron material, said structure having a central core leg and first and second outer core legs essentially parallelly extending and on opposite sides of said central core leg and spaced therefrom, first and second yoke legs magnetically joining the ends of said core legs on the right and left sides to define two coil receiving windows, and having first and second magnetic shunt assemblies each formed of magnetic iron material; and containing:

a first winding of electrically insulated wire of a diameter D formed into a first coil and a second winding of electrically insulated wire formed into a second coil, each of said first and second coils each having first and second side ends spaced apart along the axis of the respective coil;

a core insulator covering said central core leg;

said first and second coils mounted in side-by-side relationship over said core insulator on said central core leg;

and said first and second magnetic shunt assemblies sandwiched in between said coils in said first and second coil receiving windows, respectively;

a strip of electrical insulation material located between the first side end of said first coil and the one of said yoke legs which faces said first side end;

said first winding comprising a precision wound coil of the type in which said coil is formed of a plurality of layers commencing with a first layer closest to the central core leg and a last layer most remote from said central core leg, each layer being of a multiple number of winding turns including a first turn and a last turn in each said layer and with the turns of said layers being interleaved with the turns of any adjoining layers without the necessity for additional interlayer electrical insulation;

the improvement therein in which in said first coil the second layer overlying said first layer contains one turn more than the number of turns in said first layer and wherein said first turn of said first winding layer is positioned a greater distance from said one yoke leg than the first turn of the second layer and is interleaved between the first and second turns of said second layer and wherein the last turn of said first layer is positioned a greater distance from said magnetic shunt assemblies than the last turn of said second layer and is interleaved between the last and next to last turns of said second layer, whereby the effective spacing between said first coil and said magnetic structure is enhanced.

2. The invention as defined in claim 1 wherein each of said distances between said first and last turn of said first layer of said first coil, respectively, and the yoke leg and magnetic shunt assembly, respectively, is at least as great as one-half of the diameter of said insulated wire.

3. The invention as defined in claim 1 wherein said first layer contains fourteen turns of wire and said first coil is adapted to receive AC line voltage at a frequency of 50 l to 60 Hertz.

4. The invention as defined in claim 1 wherein said first coil comprises further a rectanguloid geometry.

5. The invention as defined in claim 1 wherein the distance between said first side end of said first coil and the first turn of said first layer included in said first coil is equal to one-half of the wire diameter D and wherein the distance between said second side end of said first coil and said last turn of said first layer included in said first coil is equal to one-half of the wire diameter D.

6. The invention as defined in claim 1 wherein the distance between said first side end of said first coil and the center of said first turn of said first layer included in said first coil is equal to one wire diameter D and wherein the distance between said second side end of said first coil and the center of said last turn of said first layer included in said first coil is equal to one wire diameter D.

7. The invention as defined in claim 1 further comprising: first and second electrical lead means for applying electrical voltage to said first coil, said first lead means connected to the beginning of said first turn of said first layer in said first coil and said second lead means connected to an end of said last turn of said last layer of said first coil.

8. In an electrical inductive device of the type such as a transformer or inductor containing a precision wound coil of electrically insulated wire mounted on a core of magnetic iron material in a magnetic core structure in which magnetic iron material of said structure extends along the right and left coil ends, said coil adapted to carry electrical current and create magnetic fields in said core structure, said coil containing a plurality of layers and each layer containing a plurality of turns of wire, the improvement therein wherein said first and last turns of said first layer are positioned interleaved between two turns on the second layer proximate the right side of said coil and between two turns on the second layer proximate the left side of said coil, respectively.

9. The invention as defined in claim 8 wherein said second layer contains a number of turns equal to one plus the number of turns contained in the first layer.

10. An improved precision wound coil for an inductive type electrical apparatus, such as a transformer or inductor, adapted for use in combination with a magnetic iron structure for carrying electrical current and electromagnetically coupling to said magnetic iron structure, said magnetic structure of the type including means to mount said coil in electrically insulated relationship and containing iron portions adjacent and facing the right and left end sides of said coil;

said coil containing a plurality of N layers of electrically insulated wire of diameter, D, where N equals an integer 2,3,4 . . . N, each layer containing a plurality of wire turns, said layers overlying one another, including a first layer, a second layer overlying said first layer, up to the Nth layer overlying an (N-1)st layer with the turns of one layer being interleaved with the turns of an adjoining layer;

a right side end defined by a first plane perpendicular to the axis of said coil and tangent to the surfaces of the wire in end turns of even numbered layers on the right side end;

and a left side end defined by a second plane perpendicular to the axis of said coil and tangent to the surfaces of the wire in end turns of even numbered layers on the left side end;

and said first turn of each of said odd numbered layers being spaced a distance along said axis toward the center of said coil from said right side end;

and said last turn of each of said odd numbered layers being spaced a distance of D/2 along said axis toward the center of said coil from said left side end;

whereby the electrically insulative spacing distance between said coil and said magnetic structure is enhanced.

11. An improved precision wound coil of electrically insulated wire for an inductive type electrical apparatus, such as a transformer or inductor, adapted for use in combination with a magnetic iron structure, said coil for carrying electrical current and electromagnetically coupling to said magnetic structure, said magnetic structure of the type including means to mount said coil in electrically insulated relationship and containing magnetic iron structure portions adjacent and facing the right and left end sides of said coil;

said coil containing a plurality of layers of wire in overlying relationship with each layer containing a plurality of wire turns with turns of one layer being interleaved with turns of an adjoining layer;

and the first turn of the first layer being interleaved between two turns of the second overlying layer and the last turn of the first layer being interleaved between two other turns of said second overlying layer;

whereby the electrical insulative spacing of said coil relative to said magnetic structure is enhanced.

12. The invention as defined in claim 11 wherein the number of layers in said plurality is an even integer Ne, where Ne is greater than the integer 4;

and wherein all of said even numbered layers, exclusive of the last even numbered layer, Ne, contains a number of turns, $N_{te}$, equal to one turn greater than the number of turns $N_{to}$, in the respective underlying odd numbered layer, where $N_{to}$ is an integer larger than the integer 2;

and wherein the number of turns in the last even numbered layer, the $N_e$th, is of any number greater than 1 but no larger than one turn greater than the number of turns contained in the underlying odd numbered layer.

13. The invention as defined in claim 11 wherein the number of layers in said plurality is an odd integer, $N_o$, where $N_o$ is greater than the integer 3, and wherein all of said even numbered layers contains a number of turns, $N_{te}$, equal to one turn greater than the number of turns, $N_{to}$, in the respective underlying odd numbered layer, where $N_{to}$ is larger than the integer 2.

* * * * *